United States Patent [19]

Phillips et al.

[11] Patent Number: 4,523,173

[45] Date of Patent: Jun. 11, 1985

[54] ELECTRIC SWITCHES

[75] Inventors: Richard A. Phillips, Buxton; Peter W. Naylor, Tideswell, Nr. Buxton, both of England

[73] Assignee: Otter Controls Limited, Buxton, England

[21] Appl. No.: 536,118

[22] Filed: Sep. 26, 1983

[30] Foreign Application Priority Data

Sep. 27, 1982 [GB] United Kingdom ..... 8227498
Feb. 4, 1983 [GB] United Kingdom ..... 8303075

[51] Int. Cl.[3] ..... H01H 37/54

[52] U.S. Cl. ..... 337/367; 335/166; 337/371

[58] Field of Search ..... 337/367, 370, 371, 334, 337/339, 356, 37, 55, 56, 68, 70, 71, 72; 335/164, 165, 166; 200/321, 322

[56] References Cited

U.S. PATENT DOCUMENTS 4,092,624 5/1978 Tomoyoshi ..... 337/371

*Primary Examiner*—Harold Broome
*Attorney, Agent, or Firm*—Pollock, Vande Sande & Priddy

[57] ABSTRACT

A thermally-responsive electric switch has a manually-releasable latching arrangement which makes use of a latching member (6) comprising an L-shaped or bell-crank lever having an integrally formed part (11) which constitutes a release member and connects to the end of one limb (9) of the L-shaped lever via a resilient hinge portion (12). The end of the other limb (8) of the L-shaped lever constitutes a latching abutment (10) for engagement with a member (3) of the switch. The latching member (6) is so arranged that, when the switch operates, the latching abutment (10) engages with the respective member (3) of the switch so as to preclude its return and thereby latch out the switch. Resetting is achieved by depression of the release member part (11) of the latching member (6), this causing the L-shaped lever to pivot generally about the junction of its two limbs such that the latching abutment (10) moves out of its latching position and permits the switch to reset.

14 Claims, 2 Drawing Figures

ELECTRIC SWITCHES

FIELD OF THE INVENTION

This invention generally concerns improvements relating to electric switches and more particularly concerns electric switches such as thermally-responsive switches, for example which must be reset following a switching operation and do not recycle automatically. The invention is particularly though not exclusively useful in control switches, such as element protection and automatic switch-off-upon-boiling switches, e.g., for kettles and other water boiling or cooking appliances where, as is well known, there is a need to protect the heating element of the appliance from damage in the event that the appliance is switched on without there being any water contained in the appliance, and it is furthermore desirable to switch off or reduce the power supply to the appliance automatically when its contents boil, e.g., in response to the generation of steam.

According to one aspect of the present invention, a manually-releasable latching arrangement for a switch makes use of a latching member comprising a generally L-shaped or bellcrank lever having integrally formed therewith a part which serves as a release member and is connected to the end of one limb of the L-shaped lever by means of a resilient hinge portion. The end of the other limb of the L-shaped lever constitutes a latching abutment for engagement with a member of the switch unit in question. The latching member is arranged so that, when the switch unit operates, the latching abutment engages with the respective member of the switch unit so as to preclude its return and thereby latch out the switch. Resetting is achieved by depression of the release member part of the latching member, this causing the L-shaped lever to pivot generally about the junction of its two limbs with resilient flexing of the hinge portion, such that the latching abutment constituted by the extermity of one of the said limbs moves out of its latching position and permits the switch unit to reset.

The latching member according to the invention is particularly useful for providing a manually releasable latching function in the Otter Controls Z30 over heat protector unit manufactured by and obtainable from Otter Controls Limited of Otters 'Ole, Market Street, Buxton, Derbyshire, England, but is not limited to such an application. In the application of the latching member to the Z30 unit, the latching member can be arranged to cooperate with a slide member of the unit in the performance of its latching function, the said slide member being interposed between the thermally-sensitive switch-operating actuator of the unit and its switching contacts, and the return of the slide member after a latching-out operation being essential for the reclosing of the switch contacts. A fuller appreciation of the construction and operation of the Z30 unit can be obtained from British Patent Specification No. 2 045 588A, which discloses an electrically heated jug incorporating an Otter Controls Z30 element (dry switch-on) protector unit (see particularly FIG. 4*a*) in association with an Otter Controls Z40 automatic control unit for switching off the supply of power to the jug element when water boils within the jug. Clearly, in alternative switch arrangements, the latching member could be arranged to operate directly upon the switch-operating actuator or upon the moving contact carrier of the swtich.

BACKGROUND OF THE INVENTION

Various arrangements are known in which a control for an automatic kettle, for example, includes an element protector unit (such as the aforementioned Otter Control Z30) designed to switch off the supply of power to the element in the case of over-heating caused most commonly by switching on the kettle when empty, and also includes an automatic switch-off-on-boil unit (such as the aforementioned Otter Controls Z40) commonly responsive to generation of steam in the kettle. One such arrangement, which additionally is provided with a latching function requiring manual resetting in the case either of operation of the element protector or of the switch-off-on-boil unit, is described in British Patent Specification Nos. 1 470 365, 1 470 366 and 1 470 367, and this arrangement, known as the Otter Controls VEB and obtainable from Otter Controls Limited, has found widespread acceptance and approval. Another aspect of the present invention resides in the appreciation of the usefulness of such a latching member as above described in the construction of a latching element-protection and automatic switch-off-on-boil unit in which, for example, the two switch actuators of the unit, i.e., the actuator responsive to a dry switch-on or over-heating condition and the actuator responsive to boiling of the contents of the vessel in question, are arranged to operate a moving contact carrying leaf spring which has associated with it a latching member of the kind in question. As will be appreciated from descriptions given hereinafter of an exemplary unit, such use of a single latching element provides a simple and reliable mechanism.

The latching element can of course be used to perform separate latching functions in individual element protection (dry switch on) and automatic switch-off units and, in accordance with another advantageous aspect of the present invention, this gives rise to the possibility of a modular approach in which each of the element protection and automatic switch-off functions is performed separately by means of separate switch modules of the same basic configuration but with differently set temperature responses. Each module might for example comprise a temperature sensitive bimetallic switch actuator arranged to operate the moving contact of a switch contact pair and with a latching member of the kind described associated with the moving contact or with the bimetallic actuator. All such modules might be identically constructed, but with different bimetals set or operating at the respective different temperatures required, with consequent manufacturing advantages. Using this approach, two modules could be combined on one chassis so as to provide element protection and automatic switch-off facilities in the one unit, or alternatively the two modules could be separately associated with the vessel so as best to suit its particular configuration. The modules could have provision for the connection of neon indicator lamps or like indicating devices to the modules, or could even incorporate such devices, for providing an indication of the respective switch condition.

Yet a further aspect of the present invention is in regard to the subject matter of applicants' British Patent Application No. 8307104, filed Mar. 15, 1983 which concerns an element (dry switch-on) protector unit incorporating two independent thermal sensors, such as snap-acting bimetallic elements, each controlling a separate pair of switching contacts and each in intimate thermal contact with the head of the element. Such a system has been proposed, particularly for use with water boiling vessels formed of synthetic plastic material, to provide a back-up protection operative in the event (however unlikely) of the primary protector failing to operate. In further accordance with the present invention, a latching member of the general type aforementioned might be associated with each of the primary and secondary element protection switch units, either in the form of a separate latching member for each element protection switch or in a combined form wherein, in effect, two latching members are combined into a single integral unit. As in the previously mentioned modular approach, a neon or like indicator could be associated with the unit for example to indicate malfunction of the primary protector due to its contacts failing to open. If the neon were connected across the secondary contacts, the only time it would illuminate would be when the secondary contacts opened while the primary contacts were still closed, a condition which, as explained in British Patent Application No. 8307104, would not occur if the control were operating properly.

While the latching member may conveniently be formed, for example, as a moulding of a suitable synthetic plastic material, for some applications where it may be required to withstand many thousands of cyclical operations it may be preferable, for example, to construct the latching member as a plastics and metal composite with the resilient portion formed of metal.

BRIEF DESCRIPTION OF THE DRAWINGS

The invention will best be understood from a consideration of the accompanying drawings, wherein

Referring first to FIG. 1, it is to be appreciated that, while latching of an element (dry switch-on) protection switch could be effected independently of the provision of a separate steam sensitive unit if desired, the illustrated arrangement incorporates both elements (dry switch-on) protection and steam sensitive functions. FIG. 1 thus shows an overtemperature (dry swtich-on) responsive bimetallic blade 1, which may be snap acting and of the general type described in British Pat. Nos. 600,055, 657,434 and 1,064,643 for example, or may take any other form, coupled by means of a push rod 2 with the moving contact carrying leaf spring 3 of a switch contact set further comprising a fixed contact carrier 4. A steam sensing bimetallic blade 5 is schematically shown also arranged to act upon the moving contact carrier 3 for the purpose of indicating that the latching arrangement hereinafter described is usable both with dry boil sensing and steam sensing arrangement either separately or in combination. A latching member 6 is shown associated with the moving contact carrier 3.

The latching member 6 generally comprises a molded plastic L-shaped lever having integrally formed therewith a part serving as a release member which couples with the extremity of one limb of the L-shaped lever by means of a resilient hinge portion. For some applications it might be desirable to form the latching member, at least so far as concerns its resilient hinge portion, of a more robust spring metal material. The extremity of the other limb of the L-shaped lever constitutes a latching abutment for engagement with the movable switch part of the switch unit in question. The latching member, in operation, is arranged so that, when the switch unit operates, the latching abutment engages with the respective member of the switch unit so as to preclude its return and thereby latch out the switch. Resetting is then achieved by depression of the part of the latching member which is coupled with one limb of the L-shaped lever by means of the resilient hinge, this causing the L-shaped lever to pivot generally about the junction of its two limbs, such that the latching abutment constituted by the said extremity of one of the limbs moves out of its latching position and permits the switch unit to reset.

Figure 1:
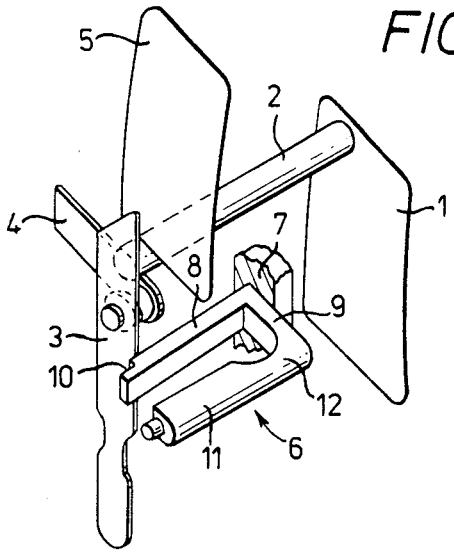
FIG. 1 is a perspective, schematic view of the application of a latching member to an element protector and automatic steam sensing switch.

More particularly with reference to FIG. 1, the latching member 6 is mounted so as to have a reaction abutment 7 in the region of the junction of the limbs 8 and 9 of its L-shaped part and with the extreme free end of its limb 8 biased against moving contact carrying leaf spring 3 so that when the leaf spring is moved by either the dry boil or the steam sensing bimetal blade 1 or 5, the notch 10 engages with the leaf spring 3 so as to prevent its return. The switch contacts are then latched open. For resetting the unit, a longitudinal force applied to the latching member part 11 causes the L-shaped part to pivot counterclockwise as viewed, with flexing of the hinge portion 12, so moving the notch 10 away from the leaf spring 3 and thus releasing the latch and permitting the switch contacts to reclose. The hinge portion 12 of the latching member 6 provides the spring biasing of the latch towards the leaf spring 3 and, it being appreciated that in a practical arrangement as opposed to the schematic arrangement shown, the latching member 6 will be constrained by the manner of its mounting as to the extent of lateral movement of its parts 8 and 11, accommodates a degree of distortion of the latching member 6 against a self generated restoring force.

The latching member 6 shown in FIG. 1 might be assembled into an associated switch unit by being received within a recess formed in or defined by or between one or other of the conventionally provided molded plastic switch body and/or housing parts. For resetting the thus incorporated latching members, the parts 11 thereof might extend through the respective molding so as to be accessible for manual operation. As will readily be appreciated, the sole requirement is to so accommodate the latching member within its associated switch that the required function is assuredly obtained with the relevant parts of the latching member moving surely in the requisite direction, i.e., the latching member is laterally supported so as to restrict any tendency for movement of its parts 8 to 12 other than in the general plane including such parts, with the release member 11 capable of a limited amount of longitudinal movement as required for pivoting the L-shaped part, a reaction abutment 7 provided at the junction or heel of the two limbs of the L-shaped part, and the limb 8 of the L-shaped part capable of a limited amount of movement generally pivotally about the reaction abutment 7 and in the plane of the latching member for moving the notch 10 (which is normally biased by the action of hinge portion 12 in the mounting of the latching member into contact with the leaf spring 3) away from the leaf spring 3 for releasing the latch.

Figure 2:
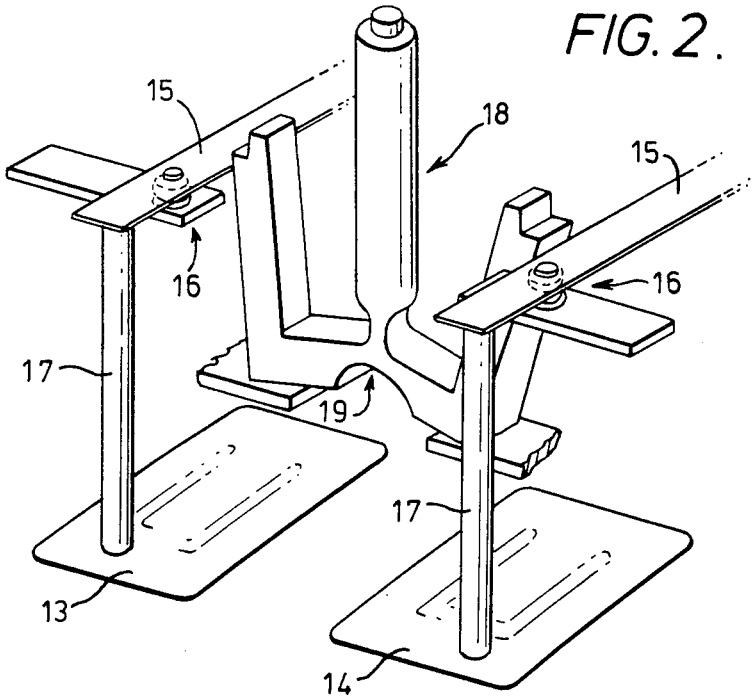
FIG. 2 is a perspective, schematic view of the application of a dual latching member to an element protection unit having primary and secondary protection.

Referring to FIG. 2, schematically illustrated therein is a dry boil element protection switching arrangement having primary and secondary bimetal blades 13 and 14 respectively each arranged to operate the moving contact carrying leaf spring 15 of a respective contact set 16 through a respective push rod 17. A dual function latching member 18 constituting, in effect, a pair of the latching members of FIG. 1 mounted back-to-back, is associated with the moving contact carriers 15; a similar arrangement could indeed have two separate latching members as in FIG. 1 mounted back-to-back. A cut-out 19 at the base of latching member 18 enhances its flexibility. The operation of the arrangment of FIG. 2 will be clear; operation of either of the bimetals 13 and 14 to open its associated switch contact, or even the contacts of both of the bimetals, will cause its associated leaf spring to be latched into a contacts open condition until reset by operation of the latching member. It will be appreciated that the arrangement of FIG. 2 could alternatively comprise an element protection unit having a first bimetal actuated switch responsive to an overtemperature condition of the element, in combination with a steam sensing unit having a second bimetal actuated switch responsive to the generation of steam within a vessel when the liquid within the vessel boils.

The latching members of FIGS. 1 and 2 can conveniently be formed of an appropriate synthetic plastic material, such as acetal homopolymer or copolymer, preferably by molding though for certain applications where the latching member may be required to withstand many thousands of cyclical operations it may be preferable to construct the latching member wholly of spring metal or as a plastic/metal composite with the resilient hinge portion formed of or reinforced with metal. The described latching members are particularly advantageous in that they generate their own spring functions for latching and restoring movements and are attitude insensitive, i.e., they can operate in any physical orientation.

While the invention has been explained herein primarily in terms of the latching of thermally-responsive switches for controlling the operation of electrically heated water boiling vessels, it will be appreciated that the invention is applicable to any form of electromechanical switch required to be provided with a manually releasable latching function. The latching members according to the invention could even be used in non-switching applications in mechanisms, such as lock mechanisms, requiring a manually-releasable latching facility.

While in the described embodiments the release member is formed integrally with the latching member, such a construction being perferred on account of its simplicity, it would clearly be possible to construct the release member non-integrally with the latching member.

We claim:

1. An electric switch having manually-releasable latching means associated with an operating member of said switch for latching said operating member in a first predetermined operating condition of said switch and preventing movement of said operating member into a second predetermined operating condition of said switch until said latching means is released, and wherein said manually-releasable latching means includes a latching member comprising a generally L-shaped lever having two limbs and mounted for pivotal movement within the plane of said limbs and generally about the junction of said limbs, and a manually operable release member coupled to the extremity of one of said limbs by means of a resilient hinge portion, said release member serving to enable the manual application of said extremity of said one limb of a force in a direction such as to cause said lever to execute said pivotal movement, said resilient hinge portion serving for accommodating the said pivotal movement of said lever during application of said force, the extremity of the other of said limbs constituting an engaging member for engagement with said operating member of said switch for latching the same in said first predetermined operating condition, the arrangement being such that, when said lever pivots under said force, said extremity of said other limb moves in a direction transverse to the respective limb and out of latching engagement with said operating member so as to enable said switch to return to its said second predetermined operating condition.

2. An electric switch according to claim 1, wherein said L-shaped lever, said release member and said resilient hinge portion are formed integrally with one another.

3. An electric switch according to claim 1, wherein said latching member is formed at least in part of molded plastic material.

4. An electric switch according to claim 3, wherein the said resilient hinge portion of the latching member is formed at least partly of spring metal material.

5. An electric switch according to claim 1, wherein said switch has primary and secondary circuits, each having latching means associated therewith, each of said latching means comprising a said latching member, the two said latching members being combined into a single integral structure, the release members of said two latching members being combined into a single combined release member which couples via respective resilient hinge portions to respective said generally L-shaped levers, the arrangement thereby providing for dual function latching of said two switch circuits.

6. An electric switch according to claim 5, wherein said latching member structure is formed at least in part of molded plastic material.

7. An electric switch according to claim 5, wherein said latching member structure is formed at least in part of molded plastic material.

8. An electrical switch according to claim 1, for use as an element protection unit for an electrically heated water boiling vessel, said unit arranged for determining the supply of electrical power to a heating element of said vessel in dependence upon the condition of a temperature-responsive switch-actuating element arranged to be responsive to the heating element temperature.

9. An electric switch according to claim 8, wherein said latching member is formed at least in part of molded plastic material.

10. An electrical switch according to claim 9, wherein the said resilient hinge portion of the latching member is formed at least partly of spring metal material.

11. An electrical switch according to claim 8, in combination with a steam sensing unit adapted to switch off the supply of electrical power to the heating element of said vessel when water is boiled in said vessel.

12. A combined electrical switch and steam sensing unit according to claim 11, wherein said steam sensing unit is arranged to operate upon the electrical switch of said element protection unit.

13. A combined electrical switch and steam sensing unit according to claim 11, wherein said steam sensing unit is arranged to operate upon a second said electrical switch separate from that operated upon by said element protection unit, and a second said manually-releasable latching means is associated with said second electrical switch.

14. A combined electrical switch and steam sensing unit according to claim 13, wherein two latching members associated with said two said electrical switches are combined into a single combined latching structure wherein said release members of said two latching members are combined into a single combined release member which couples via respective resilient hinge portions with respective generally L-shaped levers of said two latching members.

* * * * *